US005562527A

United States Patent [19]

Nauche

[11] Patent Number: 5,562,527

[45] Date of Patent: Oct. 8, 1996

[54] GRINDING MACHINE FOR GRINDING EYEGLASS LENSES

[75] Inventor: Michel Nauche, Soisy sous Montmorency, France

[73] Assignee: Essilor International Cie Generale d'Optique, Charenton le Pont, France

[21] Appl. No.: 253,864

[22] Filed: Jun. 3, 1994

[30] Foreign Application Priority Data

Jun. 25, 1993 [FR] France ..... 9307769

[51] Int. Cl.[6] ..... B24B 9/14; B24B 49/12

[52] U.S. Cl. ..... 451/9; 451/10; 451/13; 451/17; 451/42; 451/43; 451/240

[58] Field of Search ..... 451/8, 9, 10, 11, 451/12, 13, 14, 17, 21, 41, 42, 43, 237, 239, 240, 256

[56] References Cited

U.S. PATENT DOCUMENTS

| | | | |
|---|---|---|---|
| 3,798,844 | 3/1974 | Hannaman | 451/240 |
| 4,423,569 | 1/1984 | Stern et al. | 451/5 |
| 4,596,091 | 6/1986 | Daboudet et al. . | |
| 4,667,444 | 5/1987 | Langlois et al. | 451/43 |
| 4,912,880 | 4/1990 | Haddock et al. | 451/5 |
| 5,022,187 | 6/1991 | Longuet et al. | 451/240 |
| 5,161,333 | 11/1992 | Lecerf et al. | 451/240 |
| 5,321,915 | 10/1994 | Lecerf et al. | 451/240 |
| 5,398,460 | 3/1995 | Joncour | 451/42 |

FOREIGN PATENT DOCUMENTS

| | | |
|---|---|---|
| 2652775 | 4/1991 | France . |
| 2148159 | 5/1985 | United Kingdom . |

*Primary Examiner*—Timothy V. Eley
*Attorney, Agent, or Firm*—Young & Thompson

[57] ABSTRACT

A grinding machine for grinding eyeglass lenses includes at least one grinding wheel rotatably mounted on a chassis. A carriage is pivoted to the chassis to pivot about an axis parallel to the rotation axis of the grinding wheel. A support spindle is rotatably mounted on the carriage to rotate about an axis also parallel to the rotation axis of the grinding wheel and which is adapted to receive axially the lens to be ground and a template. A feeler in vertical alignment with the template is mounted on the chassis so that it is movable transversely relative to the pivot axis of the carriage. The feeler comprises a rigid pad and a tactile sensor appropriately attached to the rigid pad, at the surface thereof.

5 Claims, 1 Drawing Sheet

GRINDING MACHINE FOR GRINDING EYEGLASS LENSES

BACKGROUND OF THE INVENTION

1. Field of the Invention

Eyeglass lenses are initially manufactured as circular, elliptical or other shape blanks which are ground to size to fit the rings or surrounds of the eyeglass frames to which they are to be fitted.

2. Description of the Prior Art

They are usually trimmed to size on a grinding machine.

At present the grinding machine usually includes at least one grinding wheel rotatably mounted on a frame, a carriage pivoted to the frame to pivot about an axis parallel to the rotation axis of the grinding wheel, a support spindle rotatably mounted on the carriage to rotate about an axis also parallel to the rotation axis of the grinding wheel and which is adapted to receive axially the lens to be ground and a template, and a feeler in vertical alignment with the template and in practise mounted on the frame so that it is movable transversely relative to the pivot axis of the carriage.

The feeler is part of what is usually called a vernier head, forming the part of the latter with which the template cooperates, and it is the feeler which controls the grinding operation.

When the template is circular and is held in contact with the feeler by the weight of the carriage alone or by the combined effect of this weight and ancillary means such as springs or counterweights so that the bearing force can be adjusted as necessary, the feeler is under the control of control means which in conjunction with data on the contour of the rings or surrounds of the eyeglass frames to be equipped with the lens command a displacement causing the carriage to pivot in one direction or the other to vary the trimming accordingly at the required locations.

A proposal has been made to implement the feeler by means of strain gauges, as for example in French patent application No 2 652 775 (filed under application No 89 13031 on 5 Oct. 1989).

In practise this presupposes the intervention of an elastically deformable member and taken overall the resulting component is therefore costly, fragile and difficult to use.

Another proposal is to implement the feeler as a displacement sensor, for example an opto-electronic cell, operative between a pad on which the edge of the template rests and a plate on which the pad is mounted to pivot about an axis parallel to the pivot axis of the carriage.

The tripping threshold of the opto-electronic cell is very precise, however, and therefore difficult to adjust.

Also, the inevitable assembly clearance at the articulation between the pad and the plate is likely to introduce some degree of inaccuracy into the reference point that the combination is supposed to provide, resulting in distortion in the shape of the eyeglass lens produced.

A general object of the present invention is a grinding machine which does not have these drawbacks.

SUMMARY OF THE INVENTION

The present invention consists in a grinding machine for grinding eyeglass lenses comprising at least one grinding wheel rotatably mounted on a chassis, a carriage pivoted to the chassis to pivot about an axis parallel to the rotation axis of the grinding wheel, a support spindle rotatably mounted on the carriage to rotate about an axis also parallel to the rotation axis of the grinding wheel and which is adapted to receive axially the lens to be ground and a template, and a feeler in vertical alignment with the template and in practise mounted on the chassis so that it is movable transversely relative to the pivot axis of the carriage, wherein said feeler comprises a rigid pad and a tactile sensor appropriately attached to said rigid pad, at the surface thereof.

The tactile sensor is preferably a component whose resistance varies with the applied force.

It is a component of the type known in the trade as a "force-sensing resistor", for example.

Operating in practise as a switch, this tactile sensor is very simple to use and in this application it does not in itself require any adjustment.

Because it is rigid the pad carrying it provides a precise reference point, avoiding all risk of distortion of the shape of the eyeglass lens produced.

Finally, the tactile sensor is advantageously insensitive to vibration and moisture, which is particularly favorable to its use in a grinding machine.

The features and advantages of the invention emerge from the following description given by way of example with reference to the appended diagrammatic drawings.

DETAILED DESCRIPTION OF THE PREFERRED EMBODIMENT

Figure 1:
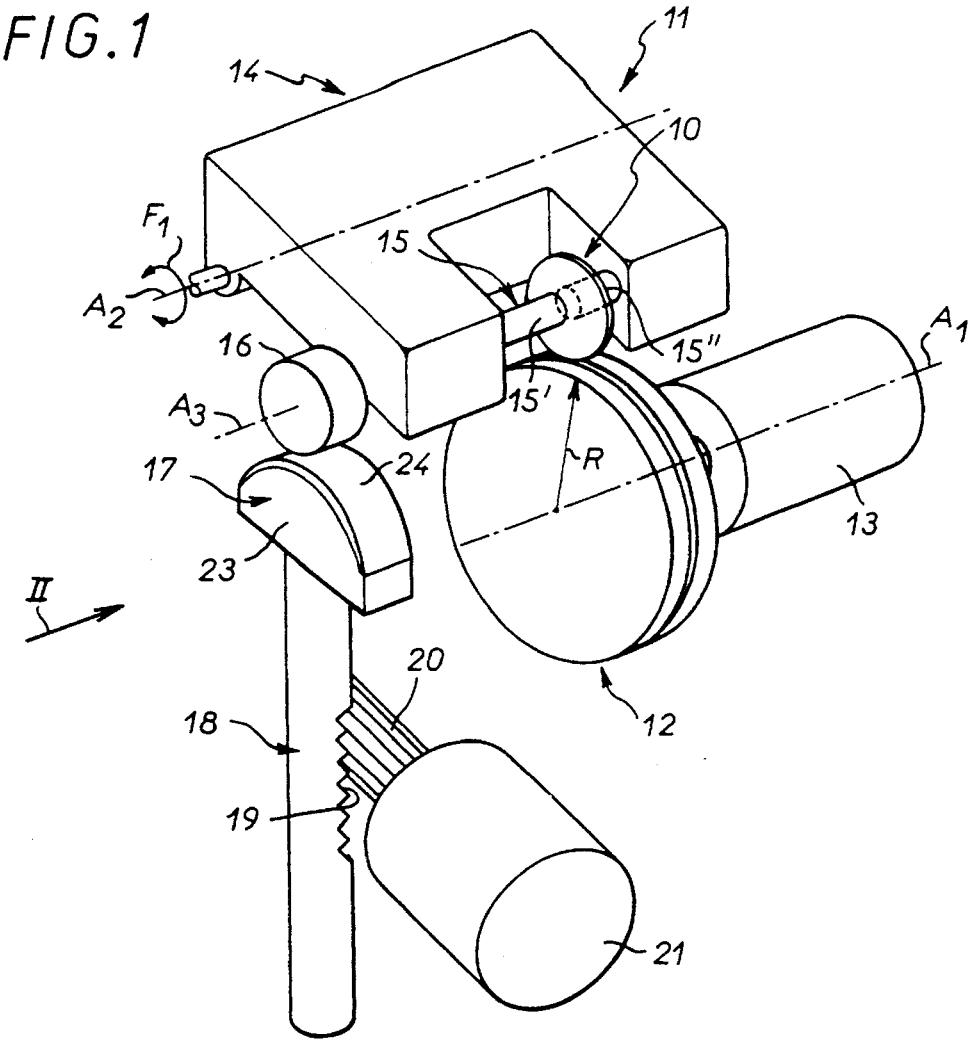
FIG. 1 is a perspective view of a grinding machine in accordance with the invention.

Referring to FIG. 1, an eyeglass lens 10 is trimmed to size on a grinding machine 11 so that it can be fitted into one of the rings or surrounds of a particular eyeglass frame (not shown).

In the known way the grinding machine 11 includes at least one grinding wheel 12 mounted on a chassis (not shown) so that it can be rotated by a motor 13 about a rotation axis A1 shown in dashed line in FIG. 1. As shown by the double-headed arrow F1 in FIG. 1, a carriage 14 is mounted on the chassis to pivot about an axis A2 shown in dashed line in FIG. 1 and parallel to the rotation axis A1 of the grinding wheel 12. A support spindle 15 is mounted to rotate on the carriage 14 about an axis A3 also shown in dashed line in FIG. 1 and also parallel to the rotation axis A1 of the grinding wheel 12. It is adapted to receive axially the eyeglass lens 10 to be ground, comprising for this purpose two half-spindles 15', 15" adapted to grip axially between them the eyeglass lens 10 fitted with appropriate holding members beforehand, and a template 16 with a feeler 17 in vertical alignment with the template 16. This latter arrangement is described in more detail below.

The grinding machine 11 is of the type described in U.S. Pat. No. 4,596,091 filed 22 Mar. 1984 under Ser. No. 592,259, for example.

Being well known in itself, the grinding wheel 12 is not described in more detail here.

Figure 2:
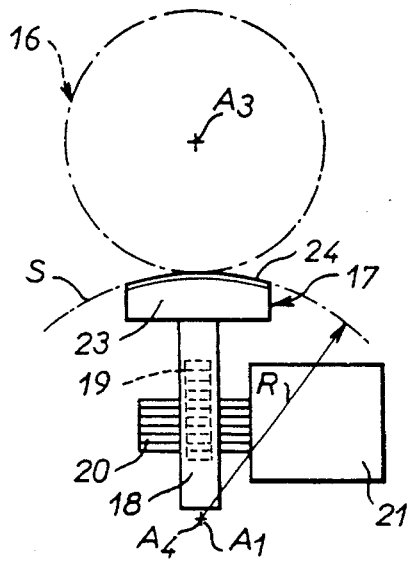
FIG. 2 is a partial side view of it as seen in the direction of the arrow II in FIG. 1.

Suffice to say that the template 16 is at the end of the support spindle 15 and that the associated feeler 17 is at the end of a support rod 18 which is mobile in the axial direction and which meshes via a rack 19 with a pinion 20 keyed to the output shaft of a motor 21 (as shown diagrammatically in FIGS. 1 and 2).

The motor 21 is under the control of a control unit 27.

In the grinding machine 11 the combination of the feeler 17 and the support rod 18 constitutes what is usually referred to as a vernier head.

According to the invention, the feeler 17 is formed by a rigid pad 23 appropriately fastened to the support rod 18 and a tactile sensor 24 appropriately attached to the rigid pad 23, at the surface thereof.

The tactile sensor 24 is glued to the rigid pad 23, for example.

As shown diagrammatically in FIG. 2, the tactile sensor 24 and the surface of the rigid pad 23 are curved to match the profile of the grinding wheel 12.

In other words, the combination forms part of a cylindrical surface S whose radius R is equal to that of the grinding wheel 12.

The axis A4 of this cylindrical surface S is in the plane containing the rotation axis A3 of the support spindle 15 and the rotation axis A1 of the grinding wheel 12, being coincident with the latter in its rest position.

The tactile sensor 24 is preferably a component whose resistance varies with the force applied to it.

This component is of the type known in the trade as a "force-sensing resistor", for example.

As this component is well known in itself and does not in itself form any part of the invention it is not described in more detail here.

Figure 3:
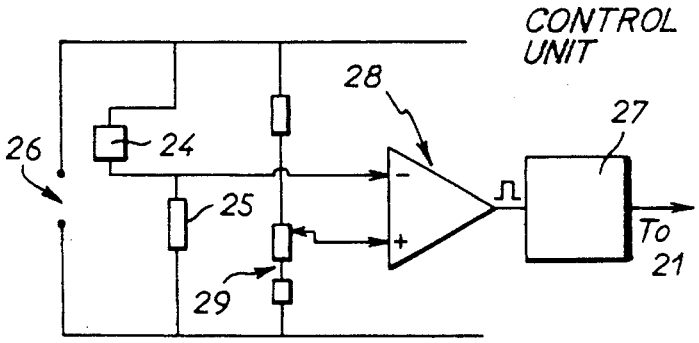
FIG. 3 is a block diagram explaining how it works.

As shown diagrammatically in FIG. 3, the tactile sensor 24 is connected in series with a resistor 25 across a power supply 26 and the voltage across it is applied to one input of a comparator 28 the other input of which receives a reference voltage, preferably a variable reference voltage, supplied by a resistor bridge 29. It outputs pulses controlling the control unit 27 which in turn controls the motor 21.

In the embodiment shown in the figures the template 16 has a circular contour.

When it bears on the feeler 17 it provides a material impediment to engagement of the eyeglass lens 10 with the grinding wheel 12.

Under the control of the control unit 27 the motor 21 moves the support rod 18 in one direction or the other and so causes tilting in one direction of the other of the carriage 14 about its rotation axis A2. The resulting modification of the relationship between the eyeglass frame and the grinding wheel 11 trims the eyeglass lens 10 to the required contour.

To this end the control unit 27 outputs shape data transmitted to it by a contour reading device operating on the ring or surround of the eyeglass frame to which the lens is to be fitted.

The pulses it receives from the comparator 28 in response to the action of the template 16 on the tactile sensor 24 cause the control unit 27 to command rotation of the motor 21 in one direction or the other.

Accordingly, the tactile sensor 24 operates as a switch.

When the voltage across it reaches the reference voltage, in either direction, the comparator 28 changes state.

In an alternative embodiment of the invention, not shown, the template 16 has a contour identical to that of the ring or surround of the eyeglass frame to which the lens is to be fitted.

In this case the feeler 17 is not mobile, being locked in position by the motor 21 and forming a fixed abutment for the template 16. As before, this enables the template 16 to materially impede engagement of the eyeglass lens 10 with the grinding wheel 12.

By virtue of arrangements which are well known in themselves and do not form any part of the present invention, and are therefore not described here, the control unit 27, in response to the action of the feeler 17, controls the grinding machine 11 as a whole and in particular its support spindle 15 according to one of the continuous, stepped or inverse machining programs provided for the grinding machine 11.

As previously, the tactile sensor 24 operates as a switch.

Of course, the present invention is not limited to the embodiment described and shown, especially with reference to the tactile sensor employed, but encompasses any variant execution thereof.

There is claimed:

1. Grinding machine for grinding eyeglass lenses comprising a chassis, at least one grinding wheel mounted for rotation on the chassis about a rotation axis, a carriage mounted on the chassis for pivotal movement about an axis parallel to the rotation axis of said grinding wheel, a support spindle mounted on said carriage for rotation about an axis also parallel to the rotation axis of the grinding wheel, means for mounting a lens to be ground on said support spindle, a template having a configuration corresponding to the contour of a desired eyeglass rim or surround and supported on said chassis, and a feeler disposed in vertical alignment with the template, said feeler comprising a rigid pad and a tactile sensor disposed on a surface of said rigid pad for cooperation with said template, and control means connected to said tactile sensor for controlling the position of the carriage relative to said chassis.

2. Grinding machine according to claim 1 wherein said tactile sensor comprises a component having an electrical resistance variable as a function of force applied thereto.

3. Grinding machine according to claim 1 wherein said tactile sensor comprises a force sensing resistor.

4. Grinding machine according to claim 1 wherein said tactile sensor and a mating surface of said rigid pad have a profile matching the profile of said at least one grinding wheel.

5. Grinding machine according to claim 1 wherein said control means comprises first and second inputs for controlling the position of the carriage relative to the chassis and a function of an output signal supplied by a comparator output, a voltage across said tactile sensor being applied to the first input and a reference voltage being applied to said second input, said control means being connected to an output of the comparator.

* * * * *